US010448730B2

(12) United States Patent
Weng

(10) Patent No.: US 10,448,730 B2
(45) Date of Patent: Oct. 22, 2019

(54) CLEANING BRUSH FOR ELIMINATING STATIC ELECTRICITY

(71) Applicant: TAIWAN BOR YING CORPORATION, New Taipei (TW)

(72) Inventor: Jin-Sheng Weng, Taipei (TW)

(73) Assignee: TAIWAN BOR YING CORPORATION, New Taipei (TW)

( * ) Notice: Subject to any disclaimer, the term of this patent is extended or adjusted under 35 U.S.C. 154(b) by 270 days.

(21) Appl. No.: 15/663,812

(22) Filed: Jul. 30, 2017

(65) Prior Publication Data

US 2018/0084899 A1 Mar. 29, 2018

(30) Foreign Application Priority Data

Sep. 29, 2016 (CN) ..... 2016 2 1089861 U

(51) Int. Cl.
*A46B 15/00* (2006.01)
*H05F 3/00* (2006.01)
*A46B 17/04* (2006.01)

(52) U.S. Cl.
CPC ..... *A46B 15/0018* (2013.01); *A46B 15/0081* (2013.01); *A46B 17/04* (2013.01); *H05F 3/00* (2013.01)

(58) Field of Classification Search
CPC . A46B 15/0081; A46B 15/0018; A46B 15/00; H05F 3/00
USPC ..... 361/221
See application file for complete search history.

(56) References Cited

U.S. PATENT DOCUMENTS 5,150,491 A * 9/1992 Ikemoto ..... A46B 9/023 132/219
2007/0138748 A1* 6/2007 Orlowski ..... F16J 15/4478 277/412

FOREIGN PATENT DOCUMENTS

JP 2001253002 A * 9/2001 ..... A46B 15/00

* cited by examiner

*Primary Examiner* — Zeev V Kitov
(74) *Attorney, Agent, or Firm* — CKC & Partners Co., LLC

(57) ABSTRACT

A cleaning brush for eliminating static electricity, including a conductive housing, wherein a containing slot is on a bottom surface of the conductive housing, and the conductive housing has two opposite end walls; and a conductive brush, which is embedded in the containing slot of the conductive housing, and is electrically connected to the conductive housing. Thus, the cleaning brush have both the functions for eliminating static electricity and removing dust.

3 Claims, 8 Drawing Sheets

CLEANING BRUSH FOR ELIMINATING STATIC ELECTRICITY

RELATED APPLICATIONS

This application claims priority to China Application Serial Number 201621089861.2, filed Sep. 29, 2016, which is herein incorporated by reference.

BACKGROUND

Field of Invention

The present invention relates to a cleaning brush. More particularly, the present invention relates to a cleaning brush for eliminating the static electricity.

Description of Related Art

Since screen or disc will accumulate dirt and dust on its surface over time, it is necessary to remove static electricity and dirt for maintaining the quality of screen or disc.

However, the conventional cleaning brushes can only remove dust, it can not eliminate static electricity. Moreover, since the removed dust will attached to the brush body of the conventional cleaning brushes, it would require an additional cleaner to clean the attached dust, hence it is inconvenient to use.

SUMMARY

The invention provides a cleaning brush for eliminating static electricity, which can both remove the dust and eliminate the static electricity.

According to an aspect of the present invention, a cleaning brush for eliminating static electricity is provided. The cleaning brush is used for removing static electricity and dust attached on the surface of the objects, the cleaning brush for eliminating static electricity includes a conductive housing, having a containing slot on a bottom surface of the conductive housing, and the conductive housing has two opposite end walls; and a conductive brush, located in the containing slot, and is electrically connected to the conductive housing.

According to an exemplary embodiment of the present invention, the conductive brush includes a base; a conductive sheet, disposed on a top surface of the base; and a plurality of conductive fibers, wrapped around a left side and a right side of the base and around the top surface of the conductive sheet in a U-shaped, wherein the base, the conductive sheet and a portion of the conductive fibers are placed in the containing slot, another portion of the conductive fibers protrudes from the bottom surface of the conductive housing in a left row and a right row, and the conductive sheet and the conductive fibers are electrically connected to the conductive housing.

According to an exemplary embodiment of the present invention, the conductive housing has a housing body and a conductive outer housing covering an outer surface of the housing body, and the housing body has a perforation; the base has a mounting hole, and the conductive sheet has a through hole; the cleaning brush further includes a conductive rod, the conductive rod has a first end portion and an opposite second end portion, the conductive rod passes through the perforation of the housing body and the through hole of the conductive sheet, and is fixed in the mounting hole of the base by the first end portion, and the second end portion pushes against the conductive outer housing; the conductive sheet and the conductive fibers are electrically connected to the conductive outer housing of the conductive housing via the conductive rod.

According to an exemplary embodiment of the present invention, the cleaning brush further includes a bottom part, pivotally disposed on the two end walls of the conductive housing, the bottom part can rotatably cover the bottom surface of the conductive housing, and the bottom part has a scraping plate on an inner wall of the bottom part corresponding to the bottom surface of the conductive housing.

According to an exemplary embodiment of the present invention, each of the end walls of the conductive housing has a protruding shaft, and each of the end walls has two positioning protruding points, one at an upper position and another at a lower position of the protruding shafts; the bottom part has a bottom plate and two end plates connecting to each other, wherein each of the end plates has a shaft hole at a position corresponding to each of the protruding shafts and a positioning hole at a position corresponding to each of the positioning protruding points, each of the shaft holes are pivotally disposed on each of the protruding shafts, and each of the positioning holes can rotatably click and engage with each of the positioning protruding points, the scraping plate is disposed on the inner wall of the bottom plate, and protrudes towards the bottom surface of the conductive housing.

According to the cleaning brush for eliminating static electricity provided in the present invention, it can both eliminate static electricity and remove dust, and it can scrap the dust attached to the end of the conductive brush by the scraping plate of the rotatable cover, hence the provided cleaning brush is very convenient.

The conductive brush and the cleaning element are integrally combined, and it can scrap the dust attached to the end of the conductive brush and the dust attached to the surface of the cleaning element during the cleaning, by the scraping plate of the rotatable cover, hence the provided cleaning brush is very convenient to carry and use.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
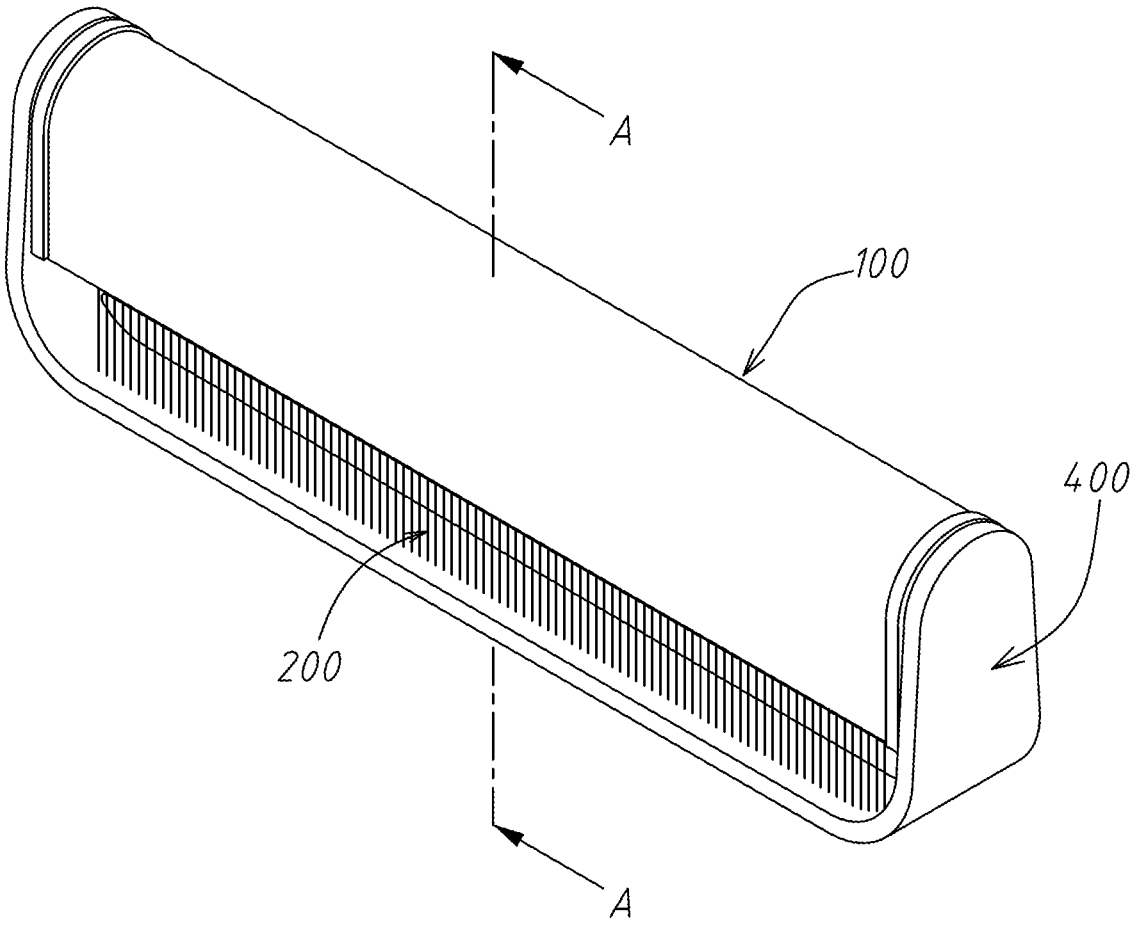
FIG. 1 is a three-dimensional diagram of a cleaning brush for eliminating static electricity according to a first exemplary embodiment of the present invention.
Figure 2:
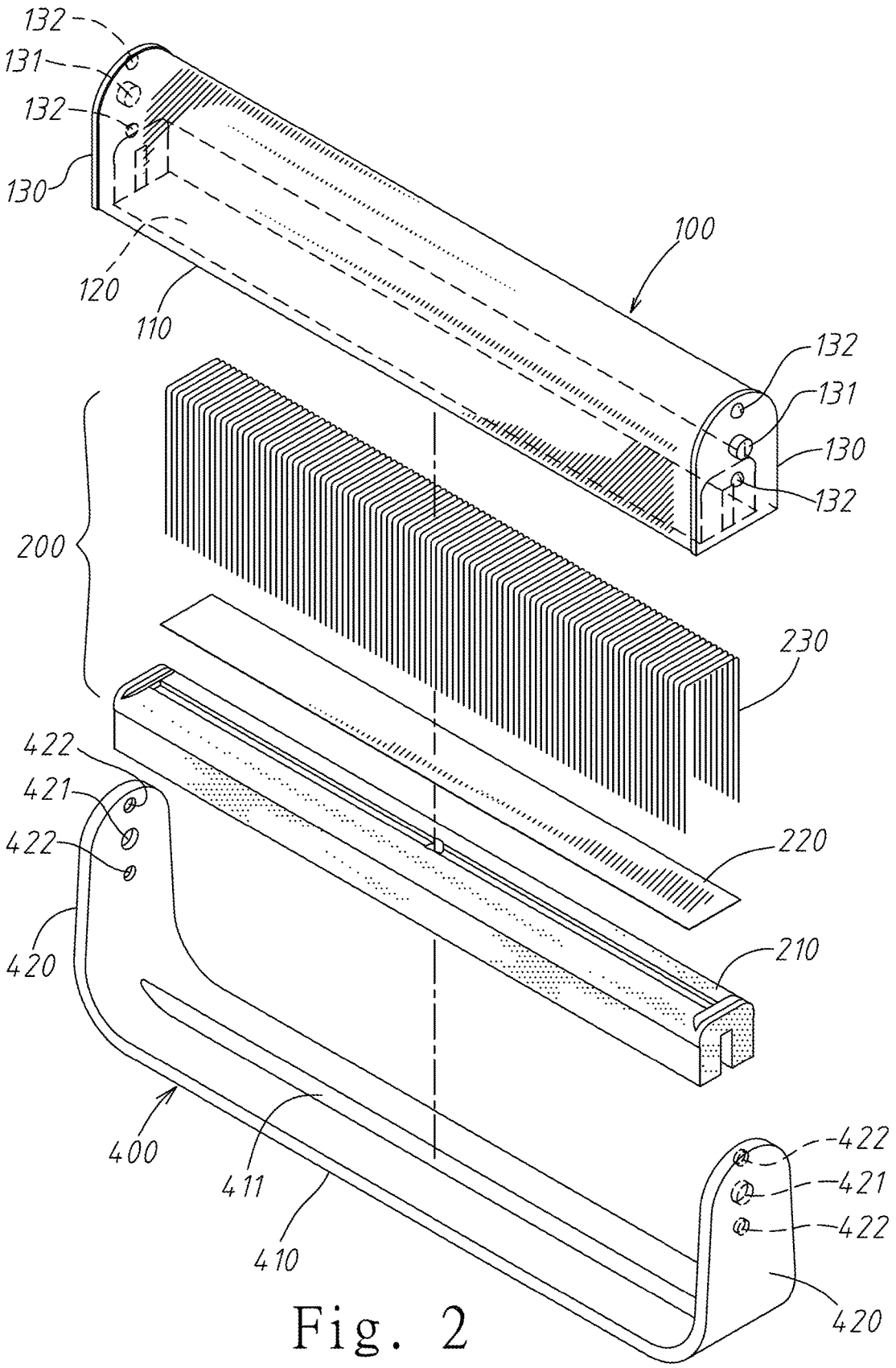
FIG. 2 is an exploded view of the cleaning brush in FIG. 1.
Figure 3:
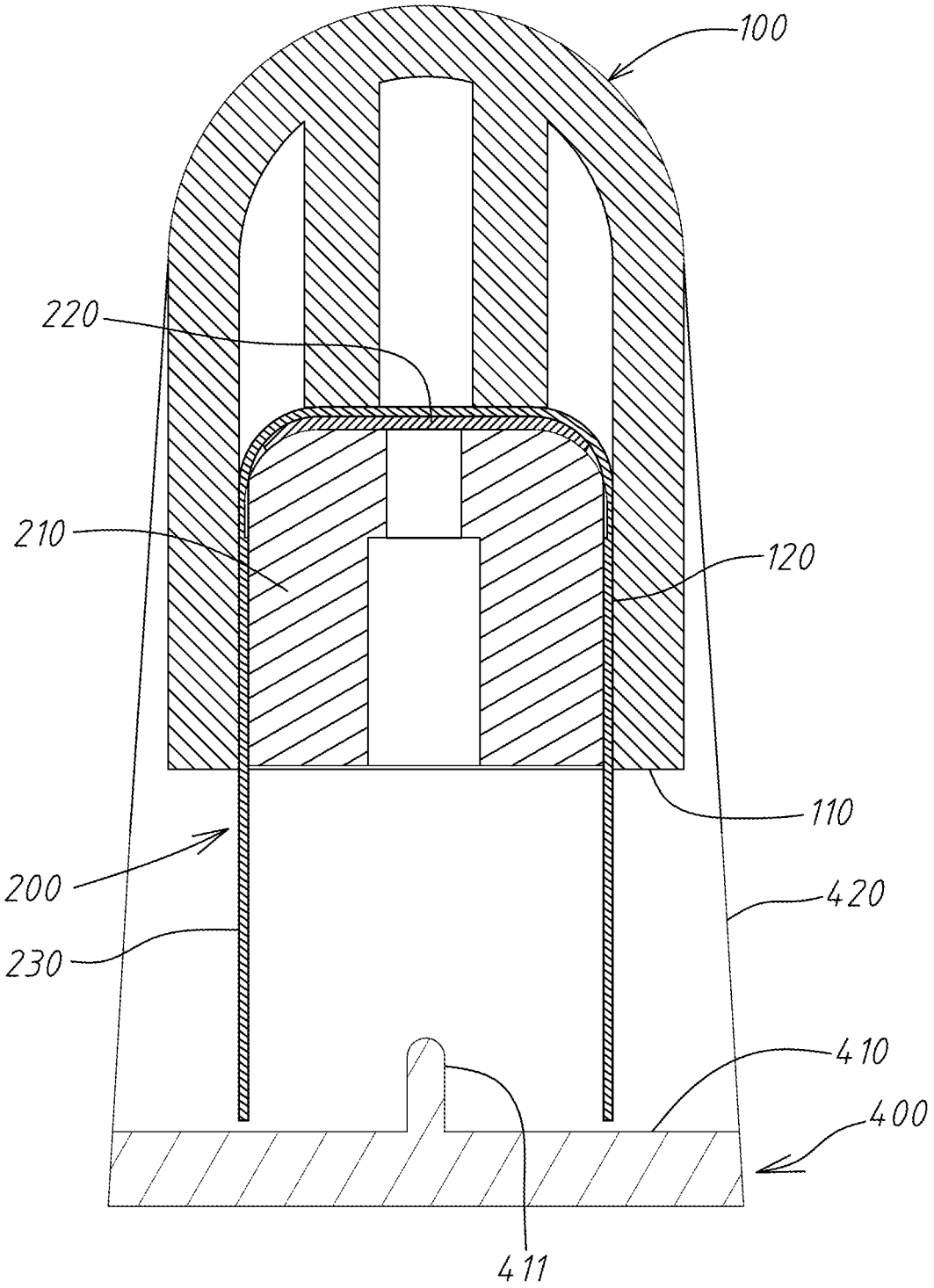
FIG. 3 is a cross-sectional view of the cleaning brush in FIG. 1 along a line A-A.
Figure 4:
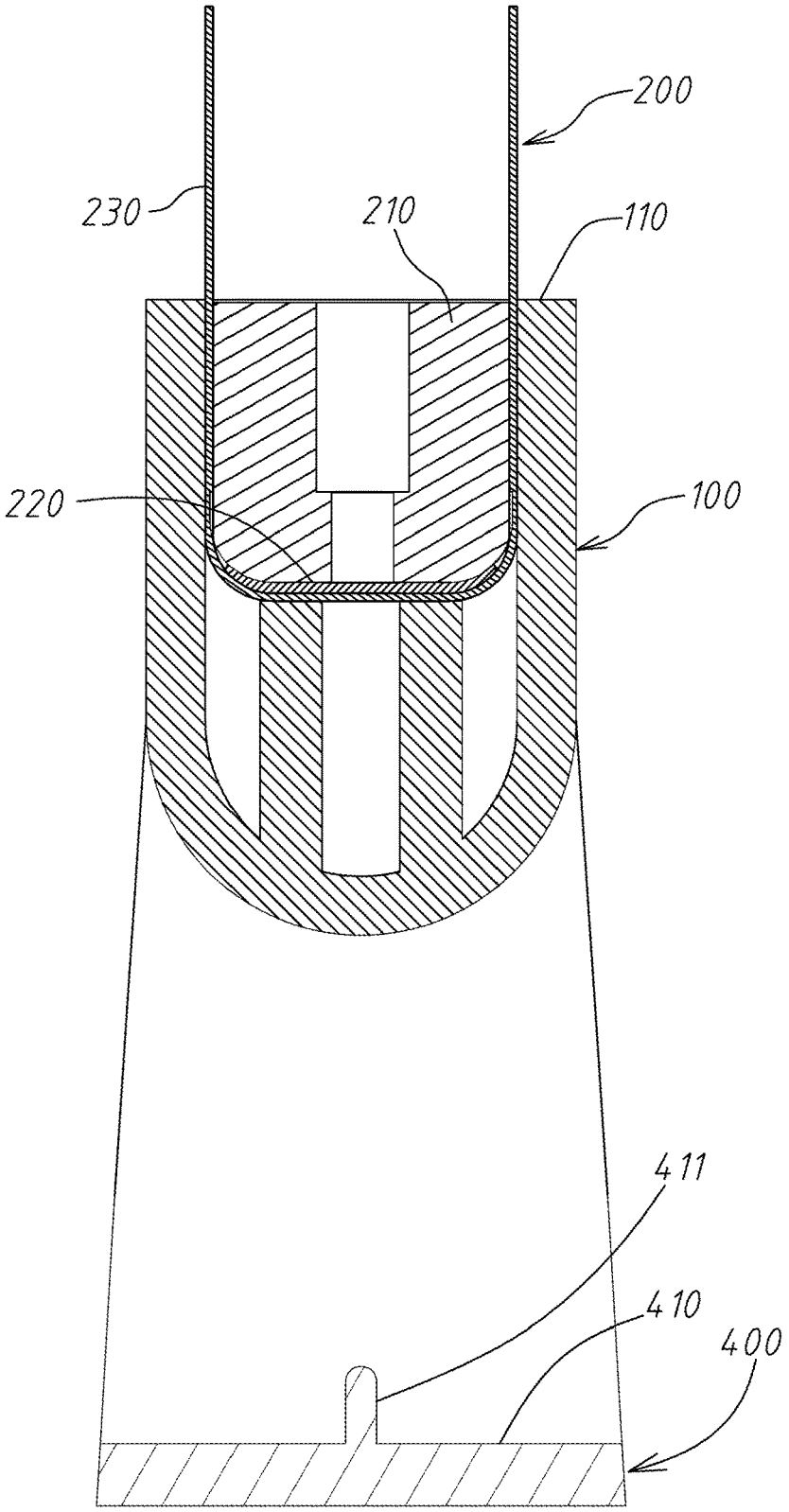
FIG. 4 is a cross-sectional view illustrating the cleaning brush in FIG. 3 rotates the conductive housing and the conducive brush upward.

Reference will now be made in detail to the present embodiments of the invention, examples of which are illustrated in the accompanying drawings. Wherever possible, the same reference numbers are used in the drawings and the description to refer to the same or like parts.

Please refer to FIG. 1 to FIG. 6. According to a first exemplary embodiment of the present invention, the cleaning brush for eliminating static electricity includes a conductive housing 100, a conductive brush 200 and a bottom part 400.

The conductive housing 100 can be made by a conductive material, such as a metal, as a whole, or it can be a conductive housing which is, for example, electroplated a metal layer on an outer surface of the housing body. A bottom surface 110 of the conductive housing 100 has a containing slot 120. The conductive housing 100 has two opposite end walls 130, each of the end walls 130 has a protruding shaft 131, and each of the end walls 130 has two positioning protruding points 132, one at an upper position and another at a lower position of the protruding shaft 131.

The conductive brush 200 is located in the containing slot 120 of the conductive housing 100, and is electrically connected to the conductive housing 100. The conductive brush 200 includes a base 210, a conductive sheet 220, and a plurality of conductive fibers 230. The base 210 is made of plastic. The conductive sheet 220 is made of a conductive material, such as metal, and it is disposed on the top surface of the base 210. The conductive fibers 230 are wrapped around a left side and a right side of the base 210 and around the top surface of the conductive sheet 220 in a U-shaped. The base 210, the conductive sheet 220 and a portion of the conductive fibers 230 are placed in the containing slot 120 of the conductive housing 100, and another portion of the conductive fibers 230 protrudes from the bottom surface 110 of the conductive housing 100 in a left row and a right row, wherein the conductive sheet 220 and the conductive fibers 230 are electrically connected to an inner wall of the conductive housing 100. The conductive sheet 220 electrically combines with the conductive fibers 230, and it has the stability of electrical conductivity.

The bottom part 400 is pivotally disposed on the two end walls 13 of the conductive housing 100, and the bottom part 400 can rotatably cover the bottom surface 110 of the conductive housing 100. The bottom part 400 has a scraping plate on an inner wall corresponding to the bottom surface 110 of the conductive housing 100. Specifically, the bottom part 400 includes a bottom plate 410 and two end plates 420; each of the end plates 420 has a shaft hole 421 at a position corresponding to each of the protruding shafts 131 of the conductive housing 100 and a positioning hole 422 at a position corresponding to each of the positioning protruding points 132 of the conductive housing 100; the shaft hole 421 of the bottom part 400 is pivotally disposed on the protruding shaft 131 of the conductive housing 100, thus the bottom part 400 can rotate around the conductive housing 100 with the protruding shaft 131 as the axis; the positioning hole 422 rotates with the bottom part 400, and when the positioning hole 422 goes to a position corresponding to the positioning protruding point 132 of the conductive housing 100, the positioning hole 422 will click and engage with the positioning protruding point 132. At this time, the bottom part 400 covers the conductive brush 200, to provide a dustproof and a protective function to the conductive brush 200, and the bottom part 400 can make the whole cleaning brush more stable.

The scraping plate 411 of the bottom part 400 is disposed on the inner wall of the bottom plate 410, and protrudes towards the bottom surface 110 of the conductive housing 100. The scraping plate 411 can clean the conductive fibers 230 of the conductive brush 200 and scrap the dust attached to the conductive fibers 230.

Figure 5:
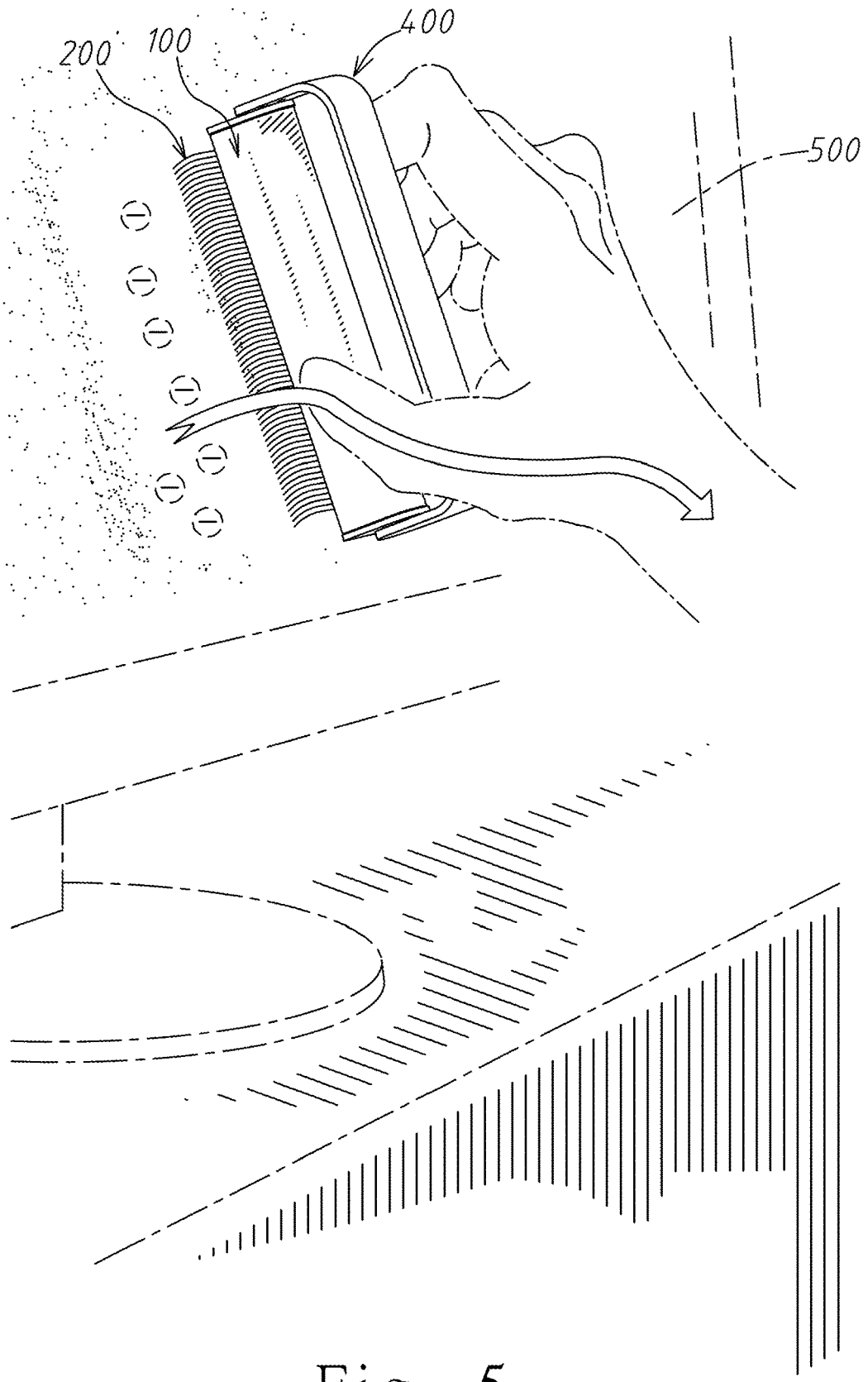
FIG. 5 is a diagram illustrating the usage of the cleaning brush in FIG. 4.

Please refer to FIG. 5; in order to remove the static electricity on the object to be cleaned, such as a disc or screen 500, both the conductive housing 100 and the conductive brush 200 should be turned to a direction opposite to the bottom part 400, so that the conductive fibers 230 of the conductive brush 200 are exposed. At this time, the user holds the conductive housing 100, and makes the conductive fibers 230 of the conductive brush 200 brush back and forth the surface of the screen 500, then static electricity on the screen 500 can be eliminated via the conductive fibers 230, the conductive sheet 220, the conductive housing 100 and the human body. While repeatedly brushes the conductive fibers 230, dust on the surface of the screen will also be removed or attached to the outer ends of the conductive fibers 230.

Figure 6:
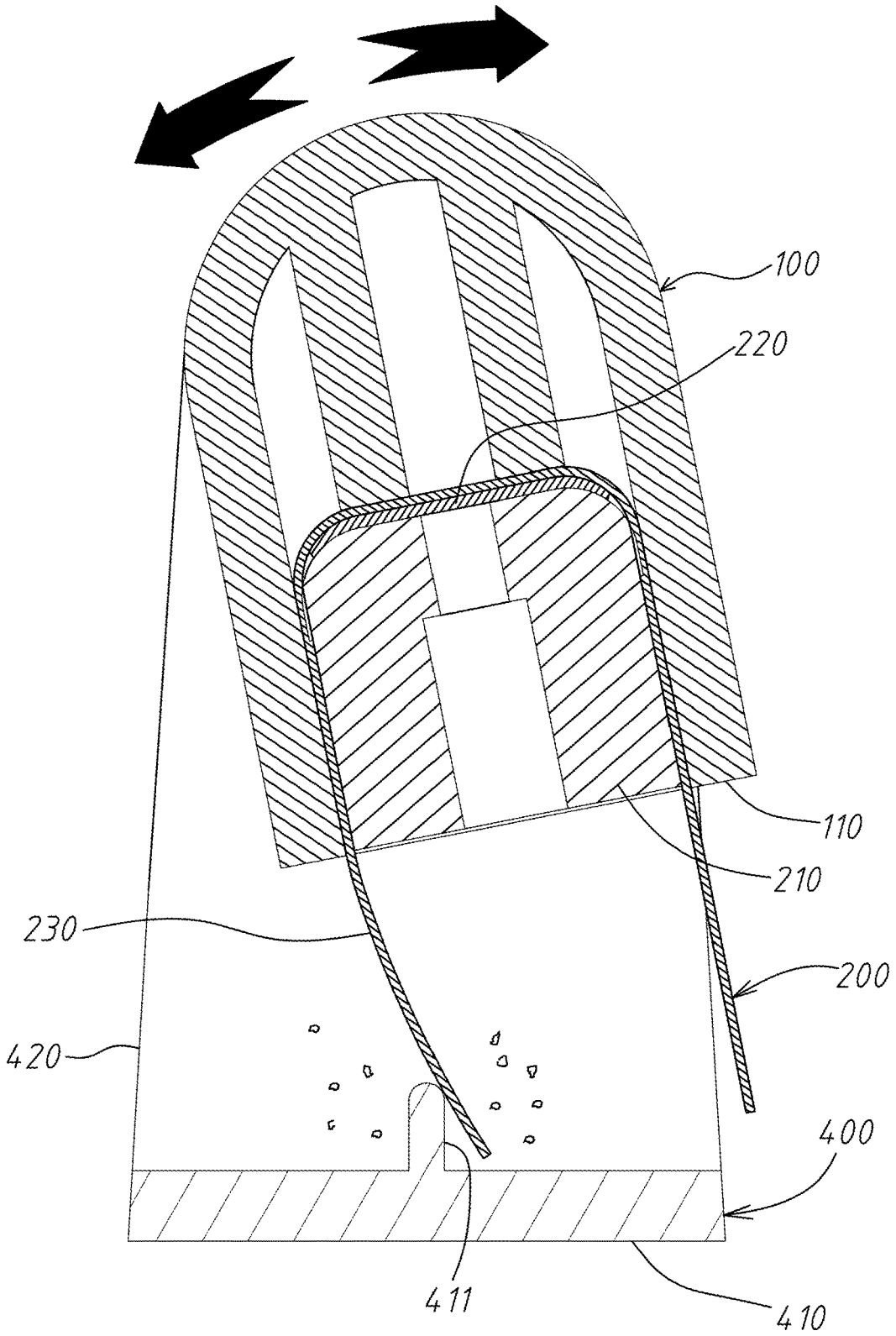
FIG. 6 is a diagram illustrating the cleaning brush in FIG. 3 scrapes the dust on the conductive brush by the scraping plate of the bottom part.

Please refer to FIG. 6; after the aforementioned static electricity elimination, it is referred to rotate the bottom part 400, so that the scraping plate 411 of the bottom part 400 passes through the conductive fibers 230 of the conductive brush 200, to clean the conductive fibers 230 and scrap the dust attached to the outer ends of the conductive fibers 230.

Figure 7:
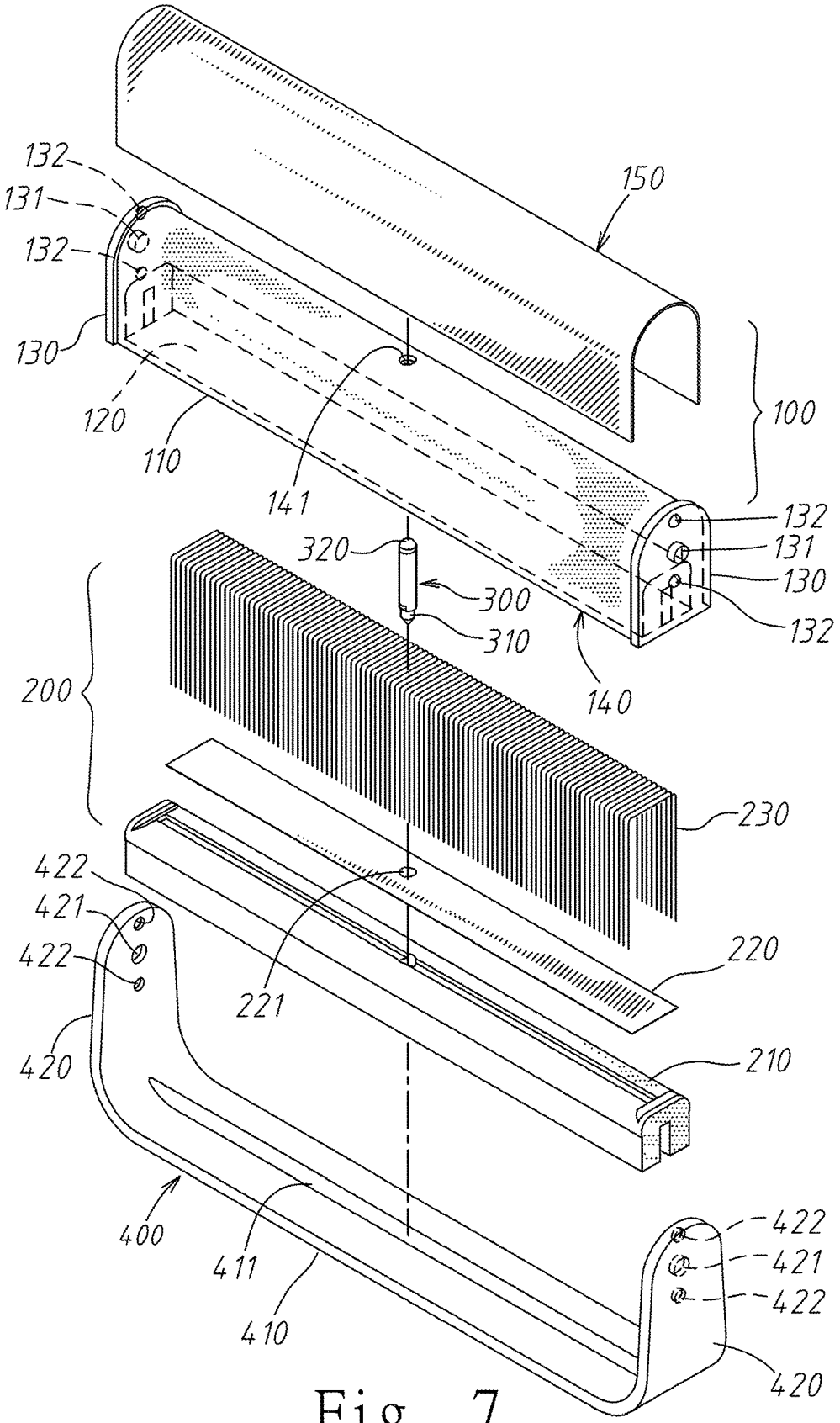
FIG. 7 is an exploded view of a cleaning brush for eliminating static electricity according to a second exemplary embodiment of the present invention.
Figure 8:
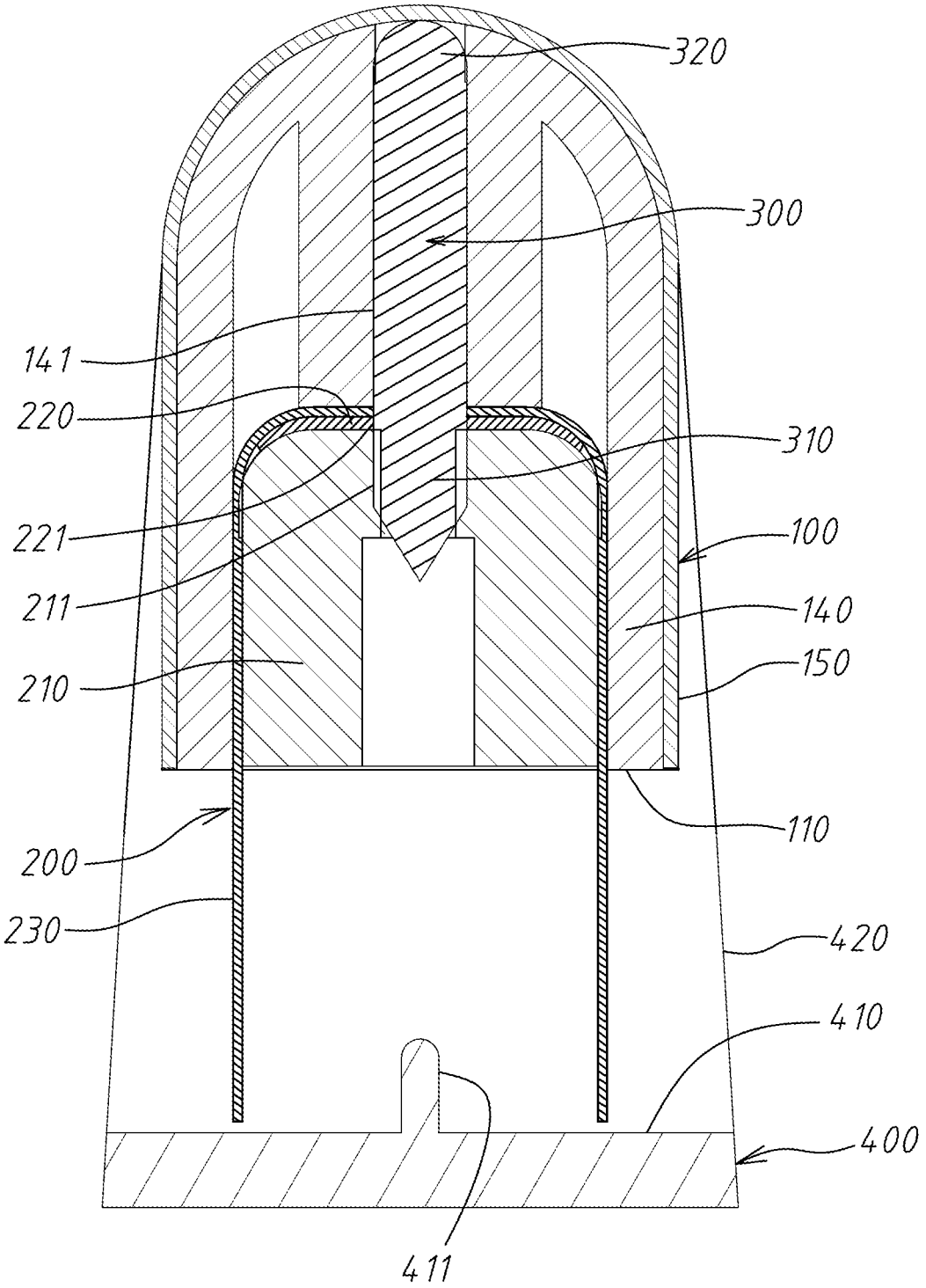
FIG. 8 is a cross-sectional view of the cleaning brush in FIG. 7.

Please refer to FIG. 7 and FIG. 8; according to a second exemplary embodiment of the present invention, a cleaning brush for eliminating static electricity includes a conductive housing 100, a conductive brush 200, a conductive rod 300 and a bottom part 400.

The difference between the second exemplary embodiment and the first exemplary embodiment is that, in the first exemplary embodiment, the conductive housing 100 is a single structure, and, in the second exemplary embodiment, the conductive housing 100 is a two-piece composite structure, and in the second exemplary embodiment, an addition conductive rod 300 is placed from the conductive brush 200 to the conductive housing 100. Other structures of the two exemplary embodiments are the same.

In detail, in the second exemplary embodiment, the conductive housing 100 includes a housing body 140 and a conductive outer housing 150 which covers an outer surface of the housing body 140, and the housing body 140 has a perforation 141. The base 210 of the conductive brush 200 has a mounting hole 211, and the conductive sheet 220 has a through hole 221. The conductive rod 300 has a first end portion 310 and an opposite second end portion 320, the conductive rod 300 passes through the perforation 141 of the housing body 140 and the through hole 221 of the conductive sheet 220, and is fixed in the mounting hole 211 of the base 210 by the first end portion 310, besides, the second end portion 320 pushes against the conductive outer housing 150. Thus, the conductive sheet 220 and the plurality of conductive fibers 230 are electrically connected to the conductive outer housing 150 of the conductive housing 100 via the conductive rod 300.

Therefore, when the user holds the conductive outer housing 150 going back and forth brushing with the conductive fibers 230, the objected to be removed, such as static electricity on the screen, can be eliminated via the conductive fibers 230, the conductive sheet 220, the conductive rod 300, the conductive outer housing 150 of the conductive housing 100, and the human body. While sweeping back and forth with the conductive fibers 230, the dust on the object to be cleaned will be also removed or attached to the outer ends of the conductive fibers 230. Then the scraping plate 411 of the bottom part 400 can scrap the dust.

According to a an exemplary embodiment of the present invention, the disclosed cleaning brush for eliminating static electricity can both eliminate static electricity and remove dust, and it can scrap the dust attached to the outer ends of the conductive brush by the scraping plate of the rotatable cover, hence the provided cleaning brush is very convenient.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A cleaning brush for eliminating static electricity, comprising:

a conductive housing, having a containing slot on a bottom surface of the conductive housing, and the conductive housing has two end walls facing each other; and a conductive brush, located in the containing slot, and is electrically connected to the conductive housing, wherein the conductive brush comprises:

a base;

a conductive sheet, disposed on a top surface of the base; and a plurality of conductive fibers, wrapped around a left side and a right side of the base and around the top surface of the conductive sheet in a U-shaped form, wherein the base, the conductive sheet, and a portion of the conductive fibers are placed in the containing slot, another portion of the conductive fibers protrudes from the bottom surface of the conductive housing in a left row and a right row, and the conductive sheet and the conductive fibers are electrically connected to the conductive housing, wherein the conductive housing comprises a housing body and a conductive outer housing covering an outer surface of the housing body, and the housing body has a perforation; the base has a mounting hole, and the conductive sheet has a through hole; the cleaning brush further has a conductive rod, the conductive rod has a first end portion and an opposite second end portion, the conductive rod passes through the perforation of the housing body and the through hole of the conductive sheet, and is fixed in the mounting hole of the base by the first end portion, and the second end portion pushes against the conductive outer housing; the conductive sheet and the conductive fibers are electrically connected to the conductive outer housing of the conductive housing via the conductive rod.

2. A cleaning brush for eliminating static electricity, comprising:

a conductive housing, having a containing slot on a bottom surface of the conductive housing, and the conductive housing has two end walls facing each other;

a conductive brush, located in the containing slot, and is electrically connected to the conductive housing; and a bottom part, pivotally disposed on the two end walls of the conductive housing, the bottom part can rotatably cover the bottom surface of the conductive housing, and the bottom part has a scraping plate on an inner wall of the bottom part corresponding to the bottom surface of the conductive housing.

3. The cleaning brush for eliminating static electricity of claim 2, wherein each of the end walls of the conductive housing has a protruding shaft, and each of the end walls has two positioning protruding points, one at an upper position and another at a lower position of the protruding shafts; the bottom part has a bottom plate and two end plates connecting to each other, wherein each of the end plates has a shaft hole at a position corresponding to each of the protruding shafts and a positioning hole at a position corresponding to each of the positioning protruding points, each of the shaft holes are pivotally disposed on each of the protruding shafts, and each of the positioning holes can rotatably click and engage with each of the positioning protruding points, the scraping plate is disposed on the inner wall of the bottom plate, and protrudes towards the bottom surface of the conductive housing.

* * * * *